US009331397B2

(12) United States Patent
Jin et al.

(10) Patent No.: US 9,331,397 B2
(45) Date of Patent: May 3, 2016

(54) TUNABLE ANTENNA WITH SLOT-BASED PARASITIC ELEMENT

(71) Applicant: Apple Inc., Cupertino, CA (US)

(72) Inventors: Nanbo Jin, Sunnyvale, CA (US); Yuehui Ouyang, Sunnyvale, CA (US); Yijun Zhou, Sunnyvale, CA (US); Enrique Ayala Vazquez, Watsonville, CA (US); Anand Lakshmanan, San Jose, CA (US); Robert W. Schlub, Cupertino, CA (US); Mattia Pascolini, Campbell, CA (US); Matthew A. Mow, Los Altos, CA (US)

(73) Assignee: Apple Inc., Cupertino, CA (US)

( * ) Notice: Subject to any disclaimer, the term of this patent is extended or adjusted under 35 U.S.C. 154(b) by 191 days.

(21) Appl. No.: 13/846,471

(22) Filed: Mar. 18, 2013

(65) Prior Publication Data

US 2014/0266922 A1 Sep. 18, 2014

(51) Int. Cl.

| | |
|---|---|
| ***H01Q 21/28*** | (2006.01) |
| ***H01Q 1/24*** | (2006.01) |
| ***H01Q 9/06*** | (2006.01) |
| ***H01Q 5/10*** | (2015.01) |

(52) U.S. Cl.

CPC ..... *H01Q 21/28* (2013.01); *H01Q 1/24* (2013.01); *H01Q 1/243* (2013.01); *H01Q 5/10* (2015.01); *H01Q 9/06* (2013.01)

(58) Field of Classification Search

USPC ..... 343/702

See application file for complete search history.

(56) References Cited

U.S. PATENT DOCUMENTS

| | | | |
|---|---|---|---|
| 6,317,094 | B1 | 11/2001 | Wu et al. |
| 6,762,729 | B2 | 7/2004 | Egashira |

(Continued)

FOREIGN PATENT DOCUMENTS

| | | |
|---|---|---|
| CN | 102110873 | 6/2011 |
| CN | 102683861 | 9/2012 |

(Continued)

OTHER PUBLICATIONS

Darnell et al., U.S. Appl. No. 13/368,855, filed Feb. 8, 2012.

(Continued)

*Primary Examiner* — Dameon E Levi
*Assistant Examiner* — Walter Davis
(74) *Attorney, Agent, or Firm* — Treyz Law Group, P.C.; G. Victor Treyz; Michael H. Lyons

(57) ABSTRACT

Electronic devices may be provided that contain wireless communications circuitry. The wireless communications circuitry may include radio-frequency transceiver circuitry and antenna structures. The antenna structures may form a dual arm inverted-F antenna. The antenna may have a resonating element formed from portions of a peripheral conductive electronic device housing member and may have an antenna ground that is separated from the antenna resonating element by a gap. A short circuit path may bridge the gap. An antenna feed may be coupled across the gap in parallel with the short circuit path. Low band tuning may be provided using an adjustable inductor that bridges the gap. The antenna may have a slot-based parasitic antenna resonating element with a slot formed between portions of the peripheral conductive electronic device housing member and the antenna ground. An adjustable capacitor may bridge the slot to provide high band tuning.

25 Claims, 8 Drawing Sheets

(56) References Cited

U.S. PATENT DOCUMENTS

| | | | | |
|---|---|---|---|---|
| 7,075,493 | B2 | 7/2006 | Azadegan et al. | |
| 7,145,513 | B1 | 12/2006 | Cohen | |
| 7,183,982 | B2 | 2/2007 | Kadambi et al. | |
| 7,408,515 | B2 | 8/2008 | Leisten | |
| 7,595,759 | B2 | 9/2009 | Schlub et al. | |
| 7,612,725 | B2 | 11/2009 | Hill et al. | |
| 7,768,462 | B2 | 8/2010 | Zhang et al. | |
| 7,889,143 | B2 | 2/2011 | Milosavljevic et al. | |
| 7,924,226 | B2 | 4/2011 | Soler Castany et al. | |
| 8,111,640 | B2 | 2/2012 | Knox | |
| 8,270,914 | B2 | 9/2012 | Pascolini et al. | |
| 8,350,761 | B2 | 1/2013 | Hill et al. | |
| 8,599,089 | B2 | 12/2013 | Bevelacqua et al. | |
| 8,610,629 | B2 | 12/2013 | Pascolini et al. | |
| 8,773,310 | B2 | 7/2014 | Shiu et al. | |
| 2003/0098812 | A1 | 5/2003 | Ying et al. | |
| 2006/0178116 | A1 | 8/2006 | Qi et al. | |
| 2008/0150815 | A1 | 6/2008 | Nakahata et al. | |
| 2009/0051604 | A1* | 2/2009 | Zhang | H01Q 1/243 343/702 |
| 2010/0231470 | A1 | 9/2010 | Lee et al. | |
| 2010/0279734 | A1 | 11/2010 | Karkinen et al. | |
| 2011/0188552 | A1 | 8/2011 | Yoon et al. | |
| 2011/0241949 | A1 | 10/2011 | Nickel et al. | |
| 2011/0250928 | A1 | 10/2011 | Schlub et al. | |
| 2012/0112969 | A1 | 5/2012 | Caballero et al. | |
| 2012/0169552 | A1 | 7/2012 | Lee et al. | |
| 2012/0176292 | A1 | 7/2012 | Hung et al. | |
| 2012/0229347 | A1* | 9/2012 | Jin | H01Q 1/243 343/702 |
| 2012/0231750 | A1 | 9/2012 | Jin et al. | |
| 2012/0299785 | A1 | 11/2012 | Bevelacqua | |
| 2013/0169490 | A1 | 7/2013 | Pascolini et al. | |

FOREIGN PATENT DOCUMENTS

| | | |
|---|---|---|
| CN | 102684722 | 9/2012 |
| EP | 1501154 | 4/2007 |

OTHER PUBLICATIONS

Zhou et al., U.S. Appl. No. 13/846,481, filed Mar. 18, 2013.
Ouyang et al., U.S. Appl. No. 13/846,459, filed Mar. 18, 2013.

* cited by examiner

TUNABLE ANTENNA WITH SLOT-BASED PARASITIC ELEMENT

BACKGROUND

This relates generally to electronic devices, and more particularly, to antennas for electronic devices with wireless communications circuitry.

Electronic devices such as portable computers and cellular telephones are often provided with wireless communications capabilities. For example, electronic devices may use long-range wireless communications circuitry such as cellular telephone circuitry to communicate using cellular telephone bands. Electronic devices may use short-range wireless communications circuitry such as wireless local area network communications circuitry to handle communications with nearby equipment. Electronic devices may also be provided with satellite navigation system receivers and other wireless circuitry.

To satisfy consumer demand for small form factor wireless devices, manufacturers are continually striving to implement wireless communications circuitry such as antenna components using compact structures. At the same time, it may be desirable to include conductive structures in an electronic device such as metal device housing components. Because conductive components can affect radio-frequency performance, care must be taken when incorporating antennas into an electronic device that includes conductive structures. Moreover, care must be taken to ensure that the antennas and wireless circuitry in a device are able to exhibit satisfactory performance over a range of operating frequencies.

It would therefore be desirable to be able to provide improved wireless communications circuitry for wireless electronic devices.

SUMMARY

Electronic devices may be provided that contain wireless communications circuitry. The wireless communications circuitry may include radio-frequency transceiver circuitry and antenna structures. The antenna structures may form a dual arm inverted-F antenna. The transceiver circuitry may be coupled to the dual arm inverted-F antenna by a transmission line.

The antenna may have a dual arm inverted-F antenna resonating element formed from portions of a peripheral conductive electronic device housing structure and may have an antenna ground that is separated from the antenna resonating element by a gap. A short circuit path may bridge the gap. An antenna feed may be coupled across the gap in parallel with the short circuit path.

Low band tuning may be provided using an adjustable inductor that bridges the gap. The adjustable inductor may include a series of fixed inductors and switching circuitry that is configured to tune the antenna by switching a selected one of the fixed inductors into use.

The antenna may have a slot-based parasitic antenna resonating element with a slot that is formed between portions of the peripheral conductive electronic device housing member and the antenna ground. An adjustable capacitor may bridge the slot to provide high band tuning.

Further features of the invention, its nature and various advantages will be more apparent from the accompanying drawings and the following detailed description of the preferred embodiments.

DETAILED DESCRIPTION

Figure 1:
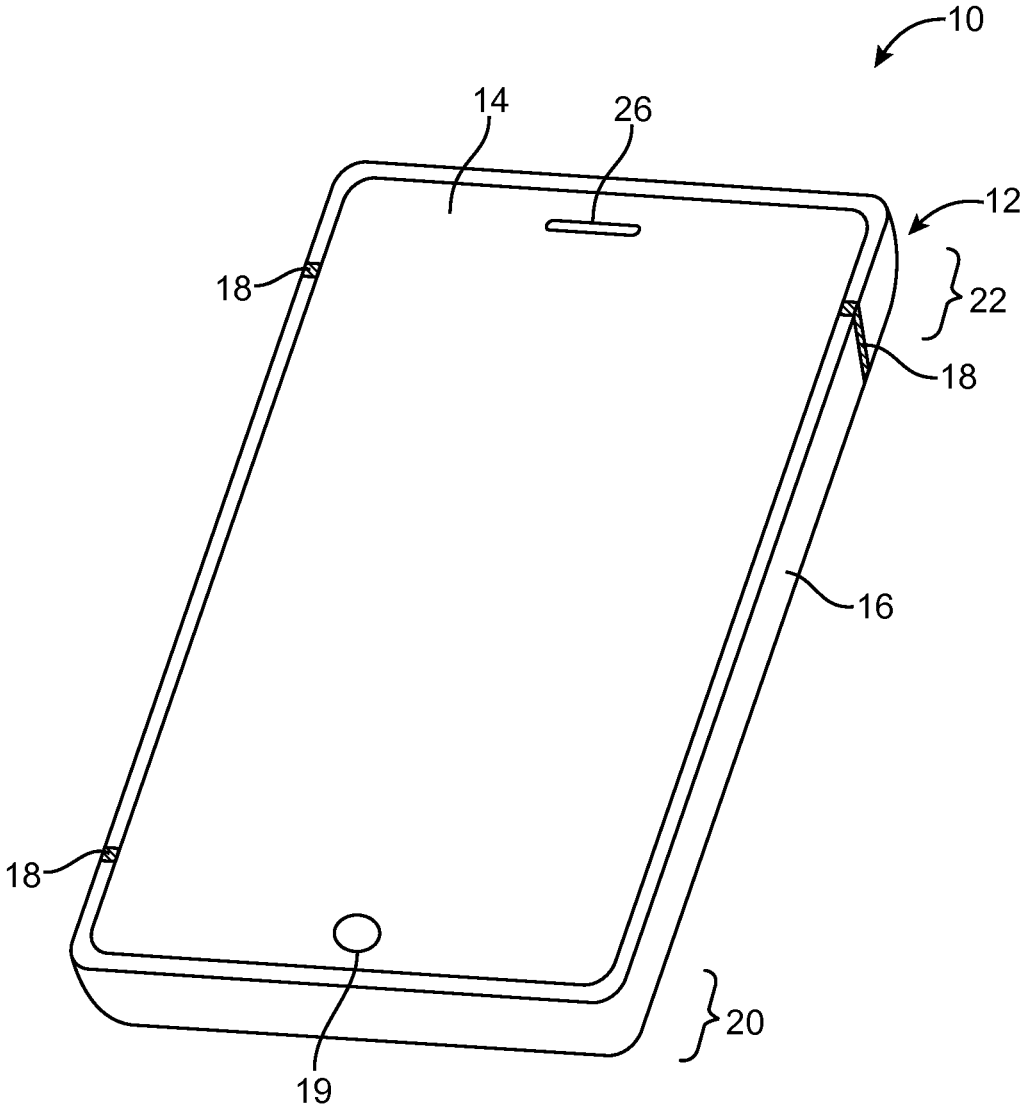
FIG. 1 is a perspective view of an illustrative electronic device with wireless communications circuitry in accordance with an embodiment of the present invention.

Electronic devices such as electronic device 10 of FIG. 1 may be provided with wireless communications circuitry. The wireless communications circuitry may be used to support wireless communications in multiple wireless communications bands. The wireless communications circuitry may include one or more antennas.

The antennas can include loop antennas, inverted-F antennas, strip antennas, planar inverted-F antennas, slot antennas, hybrid antennas that include antenna structures of more than one type, or other suitable antennas. Conductive structures for the antennas may, if desired, be formed from conductive electronic device structures. The conductive electronic device structures may include conductive housing structures. The housing structures may include peripheral structures such as a peripheral conductive member that runs around the periphery of an electronic device. The peripheral conductive member may serve as a bezel for a planar structure such as a display, may serve as sidewall structures for a device housing, and/or may form other housing structures. Gaps in the peripheral conductive member may be associated with the antennas.

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a cellular telephone, or a media player. Device 10 may also be a television, a set-top box, a desktop computer, a computer monitor into which a computer has been integrated, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material. In other situations, housing 12 or at least some of the structures that make up housing 12 may be formed from metal elements.

Device 10 may, if desired, have a display such as display 14. Display 14 may, for example, be a touch screen that incorporates capacitive touch electrodes. Display 14 may include image pixels formed from light-emitting diodes (LEDs), organic LEDs (OLEDs), plasma cells, electrowetting pixels, electrophoretic pixels, liquid crystal display (LCD) components, or other suitable image pixel structures. A cover glass layer may cover the surface of display 14. Buttons such as button 19 may pass through openings in the cover glass. The cover glass may also have other openings such as an opening for speaker port 26.

Housing 12 may include peripheral housing structures such as structures 16. Structures 16 may run around the periphery of device 10 and display 14. In configurations in which device 10 and display 14 have a rectangular shape, structures 16 may be implemented using a peripheral housing member have a rectangular ring shape (as an example). Peripheral structures 16 or part of peripheral structures 16 may serve as a bezel for display 14 (e.g., a cosmetic trim that surrounds all four sides of display 14 and/or helps hold display 14 to device 10). Peripheral structures 16 may also, if desired, form sidewall structures for device 10 (e.g., by forming a metal band with vertical sidewalls, etc.).

Peripheral housing structures 16 may be formed of a conductive material such as metal and may therefore sometimes be referred to as peripheral conductive housing structures, conductive housing structures, peripheral metal structures, or a peripheral conductive housing member (as examples). Peripheral housing structures 16 may be formed from a metal such as stainless steel, aluminum, or other suitable materials. One, two, or more than two separate structures may be used in forming peripheral housing structures 16.

It is not necessary for peripheral housing structures 16 to have a uniform cross-section. For example, the top portion of peripheral housing structures 16 may, if desired, have an inwardly protruding lip that helps hold display 14 in place. If desired, the bottom portion of peripheral housing structures 16 may also have an enlarged lip (e.g., in the plane of the rear surface of device 10). In the example of FIG. 1, peripheral housing structures 16 have substantially straight vertical sidewalls. This is merely illustrative. The sidewalls formed by peripheral housing structures 16 may be curved or may have other suitable shapes. In some configurations (e.g., when peripheral housing structures 16 serve as a bezel for display 14), peripheral housing structures 16 may run around the lip of housing 12 (i.e., peripheral housing structures 16 may cover only the edge of housing 12 that surrounds display 14 and not the rest of the sidewalls of housing 12).

If desired, housing 12 may have a conductive rear surface. For example, housing 12 may be formed from a metal such as stainless steel or aluminum. The rear surface of housing 12 may lie in a plane that is parallel to display 14. In configurations for device 10 in which the rear surface of housing 12 is formed from metal, it may be desirable to form parts of peripheral conductive housing structures 16 as integral portions of the housing structures forming the rear surface of housing 12. For example, a rear housing wall of device 10 may be formed from a planar metal structure and portions of peripheral housing structures 16 on the left and right sides of housing 12 may be formed as vertically extending integral metal portions of the planar metal structure. Housing structures such as these may, if desired, be machined from a block of metal.

Display 14 may include conductive structures such as an array of capacitive electrodes, conductive lines for addressing pixel elements, driver circuits, etc. Housing 12 may include internal structures such as metal frame members, a planar housing member (sometimes referred to as a midplate) that spans the walls of housing 12 (i.e., a substantially rectangular sheet formed from one or more parts that is welded or otherwise connected between opposing sides of member 16), printed circuit boards, and other internal conductive structures. These conductive structures may be located in the center of housing 12 under display 14 (as an example).

In regions 22 and 20, openings may be formed within the conductive structures of device 10 (e.g., between peripheral conductive housing structures 16 and opposing conductive structures such as conductive housing midplate or rear housing wall structures, a conductive ground plane associated with a printed circuit board, and conductive electrical components in device 10). These openings, which may sometimes be referred to as gaps, may be filled with air, plastic, and other dielectrics. Conductive housing structures and other conductive structures in device 10 may serve as a ground plane for the antennas in device 10. The openings in regions 20 and 22 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 20 and 22.

In general, device 10 may include any suitable number of antennas (e.g., one or more, two or more, three or more, four or more, etc.). The antennas in device 10 may be located at opposing first and second ends of an elongated device housing, along one or more edges of a device housing, in the center of a device housing, in other suitable locations, or in one or more of such locations. The arrangement of FIG. 1 is merely illustrative.

Portions of peripheral housing structures 16 may be provided with gap structures. For example, peripheral housing structures 16 may be provided with one or more gaps such as gaps 18, as shown in FIG. 1. The gaps in peripheral housing structures 16 may be filled with dielectric such as polymer, ceramic, glass, air, other dielectric materials, or combinations of these materials. Gaps 18 may divide peripheral housing structures 16 into one or more peripheral conductive segments. There may be, for example, two peripheral conductive segments in peripheral housing structures 16 (e.g., in an arrangement with two gaps), three peripheral conductive segments (e.g., in an arrangement with three gaps), four peripheral conductive segments (e.g., in an arrangement with four gaps, etc.). The segments of peripheral conductive housing structures 16 that are formed in this way may form parts of antennas in device 10.

In a typical scenario, device 10 may have upper and lower antennas (as an example). An upper antenna may, for example, be formed at the upper end of device 10 in region 22. A lower antenna may, for example, be formed at the lower end of device 10 in region 20. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, etc.

Figure 2:
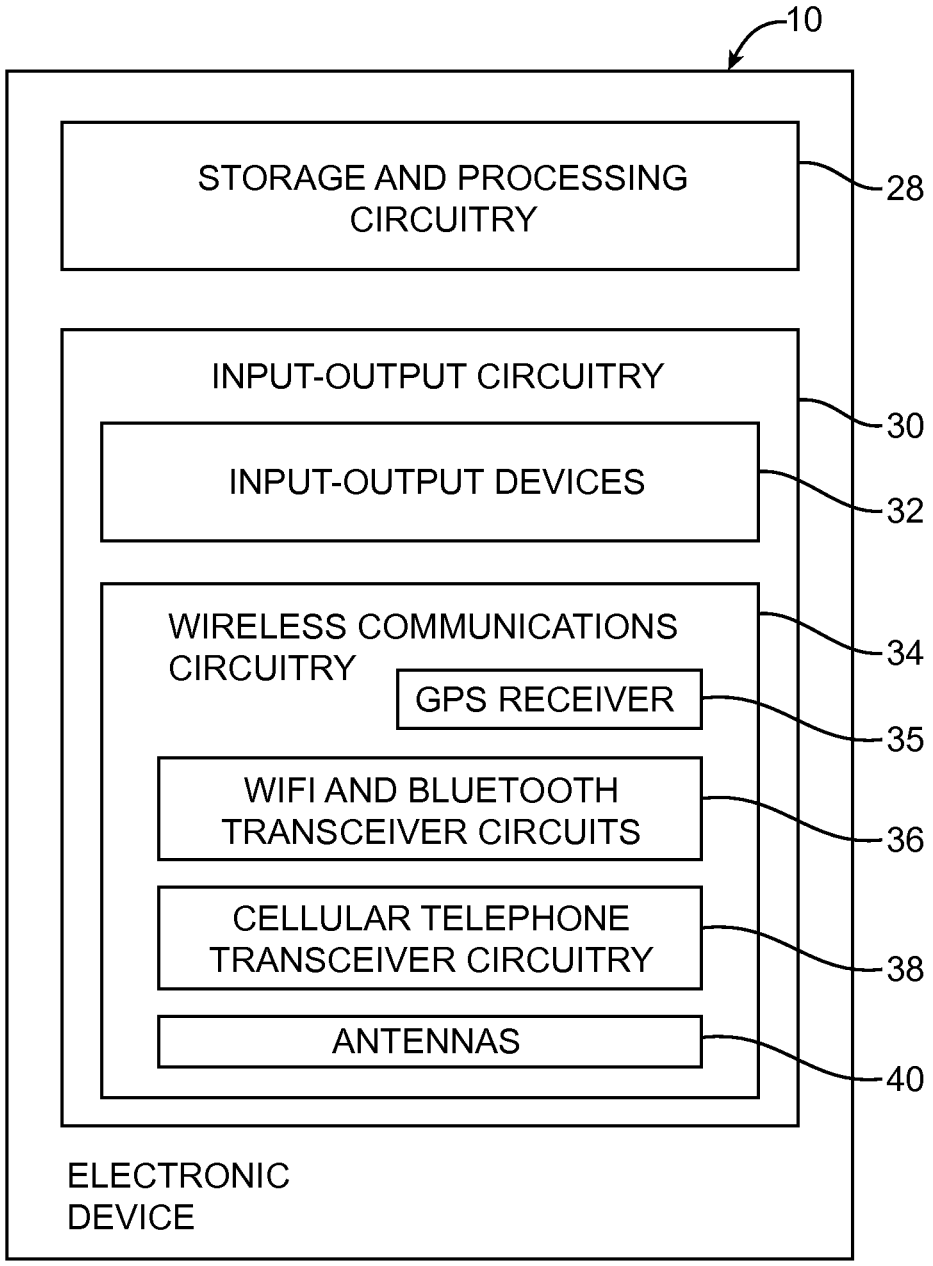
FIG. 2 is a schematic diagram of an illustrative electronic device with wireless communications circuitry in accordance with an embodiment of the present invention.

A schematic diagram of an illustrative configuration that may be used for electronic device 10 is shown in FIG. 2. As shown in FIG. 2, electronic device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. The processing circuitry may be based on one or more microprocessors, microcontrollers, digital signal processors, baseband processors, power management units, audio codec chips, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, etc.

Circuitry 28 may be configured to implement control algorithms that control the use of antennas in device 10. For example, circuitry 28 may perform signal quality monitoring operations, sensor monitoring operations, and other data gathering operations and may, in response to the gathered data and information on which communications bands are to be used in device 10, control which antenna structures within device 10 are being used to receive and process data and/or may adjust one or more switches, tunable elements, or other adjustable circuits in device 10 to adjust antenna performance. As an example, circuitry 28 may control which of two or more antennas is being used to receive incoming radio-frequency signals, may control which of two or more antennas is being used to transmit radio-frequency signals, may control the process of routing incoming data streams over two or more antennas in device 10 in parallel, may tune an antenna to cover a desired communications band, etc. In performing these control operations, circuitry 28 may open and close switches, may turn on and off receivers and transmitters, may adjust impedance matching circuits, may configure switches in front-end-module (FEM) radio-frequency circuits that are interposed between radio-frequency transceiver circuitry and antenna structures (e.g., filtering and switching circuits used for impedance matching and signal routing), may adjust switches, tunable circuits, and other adjustable circuit elements that are formed as part of an antenna or that are coupled to an antenna or a signal path associated with an antenna, and may otherwise control and adjust the components of device 10.

Input-output circuitry 30 may be used to allow data to be supplied to device 10 and to allow data to be provided from device 10 to external devices. Input-output circuitry 30 may include input-output devices 32. Input-output devices 32 may include touch screens, buttons, joysticks, click wheels, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 32 and may receive status information and other output from device 10 using the output resources of input-output devices 32.

Wireless communications circuitry 34 may include radio-frequency (RF) transceiver circuitry formed from one or more integrated circuits, power amplifier circuitry, low-noise input amplifiers, passive RF components, one or more antennas, and other circuitry for handling RF wireless signals. Wireless signals can also be sent using light (e.g., using infrared communications).

Wireless communications circuitry 34 may include satellite navigation system receiver circuitry such as Global Positioning System (GPS) receiver circuitry 35 (e.g., for receiving satellite positioning signals at 1575 MHz) or satellite navigation system receiver circuitry associated with other satellite navigation systems. Wireless local area network transceiver circuitry such as transceiver circuitry 36 may handle 2.4 GHz and 5 GHz bands for WiFi® (IEEE 802.11) communications and may handle the 2.4 GHz Bluetooth® communications band. Circuitry 34 may use cellular telephone transceiver circuitry 38 for handling wireless communications in cellular telephone bands such as bands in frequency ranges of about 700 MHz to about 2700 MHz or bands at higher or lower frequencies. Wireless communications circuitry 34 can include circuitry for other short-range and long-range wireless links if desired. For example, wireless communications circuitry 34 may include wireless circuitry for receiving radio and television signals, paging circuits, etc. Near field communications may also be supported (e.g., at 13.56 MHz). In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include one or more antennas 40. Antennas 40 may be formed using any suitable antenna types. For example, antennas 40 may include antennas with resonating elements that are formed from loop antenna structures, patch antenna structures, inverted-F antenna structures, dual arm inverted-F antenna structures, closed and open slot antenna structures, planar inverted-F antenna structures, helical antenna structures, strip antennas, monopoles, dipoles, hybrids of these designs, etc. Different types of antennas may be used for different bands and combinations of bands. For example, one type of antenna may be used in forming a local wireless link antenna and another type of antenna may be used in forming a remote wireless link. Antenna structures in device 10 such as one or more of antennas 40 may be provided with one or more antenna feeds, fixed and/or adjustable components, and optional parasitic antenna resonating elements so that the antenna structures cover desired communications bands.

Figure 3:
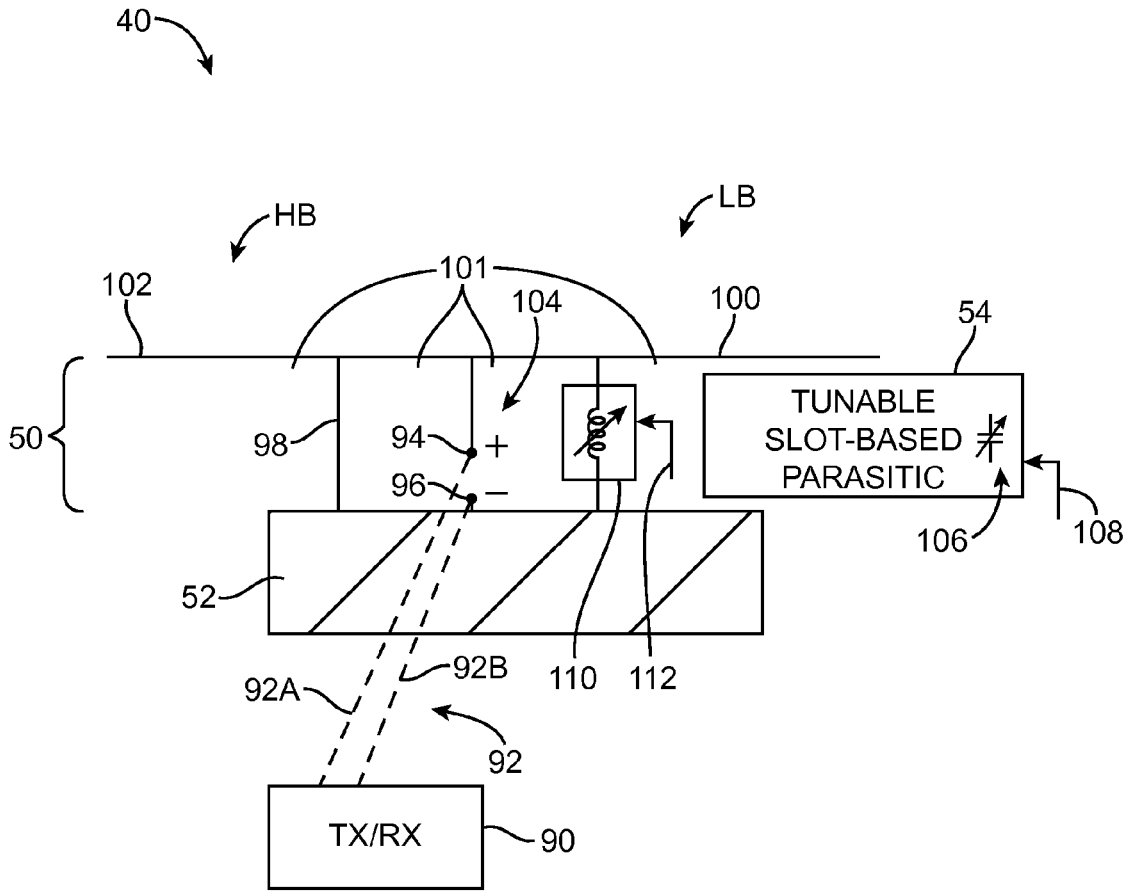
FIG. 3 is a diagram of an illustrative tunable antenna in accordance with an embodiment of the present invention.

An illustrative antenna of the type that may be used in device 10 (e.g., in region 20 and/or region 22) is shown in FIG. 3. The illustrative antenna of FIG. 3 uses a design of the type that is sometimes referred to as a dual arm inverted-F antenna or T antenna. As shown in FIG. 3, antenna 40 may have conductive antenna structures such as dual arm inverted-F antenna resonating element 50, optional parasitic antenna resonating element 54, and antenna ground 52. The conductive structures that form antenna resonating element 50, parasitic antenna resonating element 54, and antenna ground 52 may be formed from parts of conductive housing structures, from parts of electrical device components in device 10, from printed circuit board traces, from strips of conductor such as strips of wire and metal foil, or other conductive materials.

As shown in FIG. 3, transceiver circuitry 90 may be coupled to antenna 40 using transmission line structures such as transmission line 92. Transmission line 92 may have positive signal path 92A and ground signal path 92B. Paths 92A and 92B may be formed from metal traces on rigid printed circuit boards, may be formed from metal traces on flexible printed circuits, may be formed on dielectric support structures such as plastic, glass, and ceramic members, may be formed as part of a cable, etc. Transmission line 92 may be formed using one or more microstrip transmission lines, stripline transmission lines, edge coupled microstrip transmission lines, edge coupled stripline transmission lines, coaxial cables, or other suitable transmission line structures. Circuits such as impedance matching circuits, filters, switches, duplexers, diplexers, and other circuitry may, if desired, be interposed in transmission line path 92.

Transmission line 92 may be coupled to an antenna feed formed from antenna feed terminals such as positive antenna feed terminal 94 and ground antenna feed terminal 96. Antenna resonating element 50 may include a short circuit branch such as branch 98 that couples resonating element arm structures such as arms 100 and 102 to antenna ground 52. Dielectric gap 101 separates arms 100 and 102 from antenna ground 52. Antenna ground 52 may be formed from housing structures such as a metal midplate member, printed circuit traces, metal portions of electronic components, or other conductive ground structures. Gap 101 may be formed by air, plastic, and other dielectric materials. Feed path 104 contains the antenna feed formed from feed terminals 94 and 96 and is coupled between the resonating element arm structures and antenna ground 52 in parallel with short circuit path 98. Resonating element arms 100 and 102 may have one or more bends. The illustrative arrangement of FIG. 3 in which arms 100 and 102 run parallel to ground 52 is merely illustrative.

Low-band arm 100 may allow antenna 40 to exhibit an antenna resonance at low band (LB) frequencies (e.g., 700 MHz to 960 MHz or other suitable frequencies). High-band arm 102 may allow antenna 40 to exhibit one or more antenna resonances at high band (HB) frequencies (e.g., resonances at frequencies between 960 MHz to 2700 MHz or other suitable frequencies).

If desired, antenna 40 may include optional parasitic antenna resonating elements such as parasitic antenna resonating element 54. Parasitic antenna resonating element 54 is coupled to antenna resonating element 50 by near-field electromagnetic coupling and is used to modify the frequency response of antenna 40 so that antenna 40 operates at desired frequencies.

In the example of FIG. 3, parasitic antenna resonating element 54 is based on a slot antenna resonating element structure. Slot-type resonating element structures may include open slot structures (i.e., slots with one open end and one closed end) and closed slot structures (i.e., slots that are completely surrounded by metal). Slots for a slot-based parasitic antenna resonating element may be formed between opposing metal structures in antenna resonating element 50 and/or antenna ground 52. Plastic, air, or other dielectric may fill the interior of a slot. Slots are typically elongated (i.e., their lengths are substantially longer than their widths). Metal surrounds the periphery of the slot. In an open slot, one of the ends of the slot is open to surrounding dielectric.

To provide antenna 40 with tuning capabilities, antenna 40 may include adjustable circuitry. The adjustable circuitry may form part of antenna resonating element 50, optional parasitic elements such as parasitic antenna resonating element 54, or the structures of antenna ground 52.

As shown in FIG. 3, for example, parasitic antenna resonating element 54 may be a tunable parasitic resonating element that includes adjustable circuitry such as adjustable capacitor 106. The adjustable circuitry of tunable slot-based parasitic antenna resonating element 54 such as adjustable capacitor 106 may be tuned using control signals from control circuitry 28 (FIG. 2). Control signals from control circuitry 28 may, for example, be provided to tunable slot-based parasitic antenna resonating element using control input path 108 to adjust the capacitance exhibited by adjustable capacitor 106. By selecting a desired capacitance value for capacitor 106 using control signals on path 108, antenna 40 can be tuned to cover operating frequencies of interest.

If desired, the adjustable circuitry of antenna 40 may include one or more adjustable circuits that are coupled to antenna resonating element structures 50 such as arms 102 and 100 in antenna resonating element 50. As shown in FIG. 3, for example, adjustable inductor 110 may be coupled between antenna resonating element arm structures in antenna 40 such as arm 100 (or arm 102) and antenna ground 52 (i.e., inductor 110 may bridge gap 101). Adjustable inductor 110 may exhibit an inductance value that is adjusted in response to control signals provided to control input 112 of adjustable inductor 110 from control circuitry 28.

During operation of device 10, control circuitry such as storage and processing circuitry 28 of FIG. 2 may make antenna adjustments by providing control signals to adjustable components such as adjustable inductors, adjustable capacitors, adjustable resistors, switches, switches in adjustable inductors, adjustable capacitors, and adjustable resistors, adjustable components such as variable inductors, varactors, and variable resistors, adjustable circuits that include combinations of two or more of these components and/or fixed inductors, capacitors, and resistors, or by providing control signals to other adjustable circuitry. Antenna frequency response adjustments may be made in real time in response to information identifying which communications bands are active, in response to feedback related to signal quality or other performance metrics, sensor information, or other information.

Figure 4:
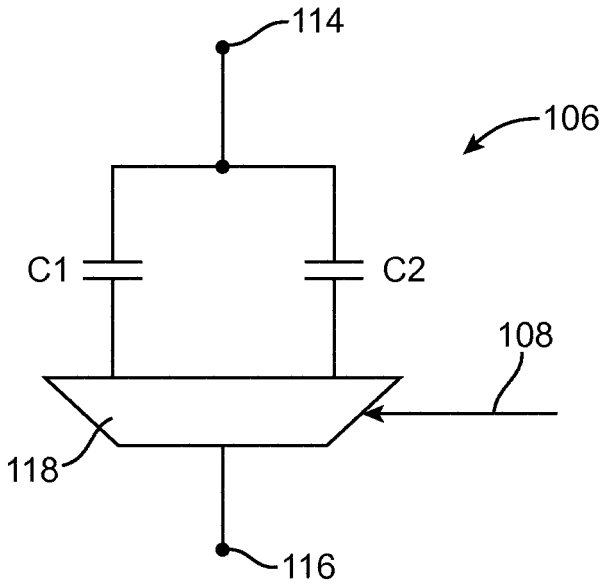
FIG. 4 is a diagram of an illustrative adjustable capacitor of the type that may be used in tuning an antenna in an electronic device in accordance with an embodiment of the present invention.

FIG. 4 is a schematic diagram of an illustrative adjustable capacitor circuit. Adjustable capacitor 106 of FIG. 4 produces an adjustable amount of capacitance between terminals 114 and 116 in response to control signals provided to input path 108. Switching circuitry 118 has two terminals coupled respectively to capacitors C1 and C2 and has another terminal coupled to terminal 116 of adjustable capacitor 106. Capacitor C1 is coupled between terminal 114 and one of the terminals of switching circuitry 118. Capacitor C2 is coupled between terminal 114 and the other terminal of switching circuitry 118 in parallel with capacitor C1. By controlling the value of the control signals supplied to control input 108, switching circuitry 118 may be configured to produce a desired capacitance value. For example, switching circuitry 118 may be configured to switch capacitor C1 into use or may be configured to switch capacitor C2 into use.

If desired, switching circuitry 118 may include one or more switches or other switching resources that selectively decouple capacitors C1 and C2 (e.g., by forming an open circuit so that the path between terminals 114 and 116 is an open circuit and both capacitors are switched out of use). Switching circuitry 118 may also be configured (if desired) so that both capacitors C1 and C2 can be simultaneously switched into use. Other types of switching circuitry 118 such as switching circuitry that exhibits fewer switching states or more switching states may be used if desired. Adjustable capacitors such as adjustable capacitor 106 may also be implemented using variable capacitor devices (sometimes referred to as varactors). The configuration of FIG. 4 is merely illustrative.

Figure 5:
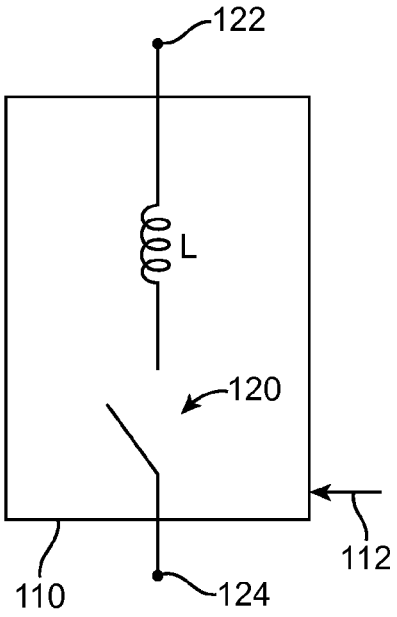
FIG. 5 is a diagram of an illustrative adjustable single-element inductor that may be used in tuning an antenna in an electronic device in accordance with an embodiment of the present invention.

FIG. 5 is a schematic diagram of adjustable inductor circuitry 110. In the FIG. 5 example, adjustable indictor circuitry 110 can be adjusted to produce different amounts of inductance between terminals 112 and 124. Switch 120 is controlled by control signals on control input 112. When switch 120 is placed in a closed state, inductor L is switched into use and adjustable inductor 110 exhibits an inductance L between terminals 122 and 124. When switch 120 is placed in an open state, inductor L is switched out of use and adjustable inductor 110 exhibits an essentially infinite amount of inductance between terminals 122 and 124.

Figure 6:
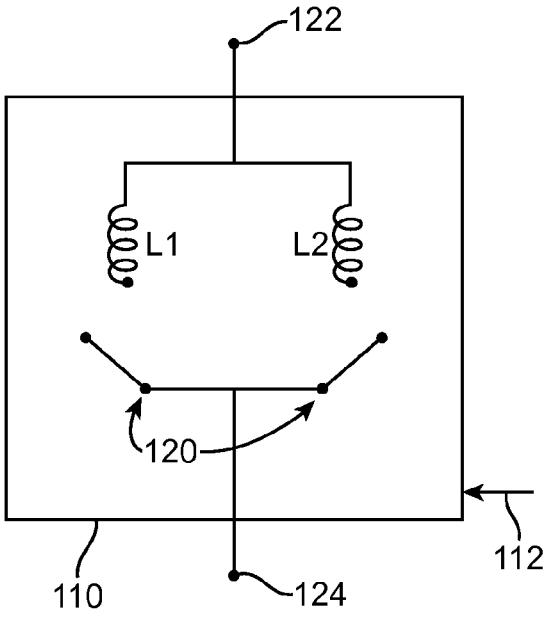
FIG. 6 is a diagram of an illustrative adjustable multi-element inductor in accordance with an embodiment of the present invention.

FIG. 6 is a schematic diagram of adjustable inductor circuitry 110 in a configuration in which multiple inductors are used in providing an adjustable amount of inductance. Adjustable inductor circuitry 110 of FIG. 6 can be adjusted to produce different amounts of inductance between terminals 112 and 124 by controlling the state of switching circuitry such as switch 120 (e.g., a single pole double throw switch) using control signals on control input 112. For example, control signals on path 112 may be used to switch inductor L1 into use between terminals 122 and 124 while switching inductor L2 out of use, may be used to switch inductor L2 into use between terminals 122 and 124 while switching inductor L1 out of use, may be used to switch both inductors L1 and L2 into use in parallel between terminals 122 and 124, or may be used to switch both inductors L1 and L2 out of use. The switching circuitry arrangement of adjustable inductor 110 of FIG. 6 is therefore able to produce one or more different inductance values, two or more different inductance values, three or more different inductance values, or, if desired, four different inductance values (e.g., L1, L2, L1 and L2 in parallel, or infinite inductance when L1 and L2 are switched out of use simultaneously).

Figure 7:
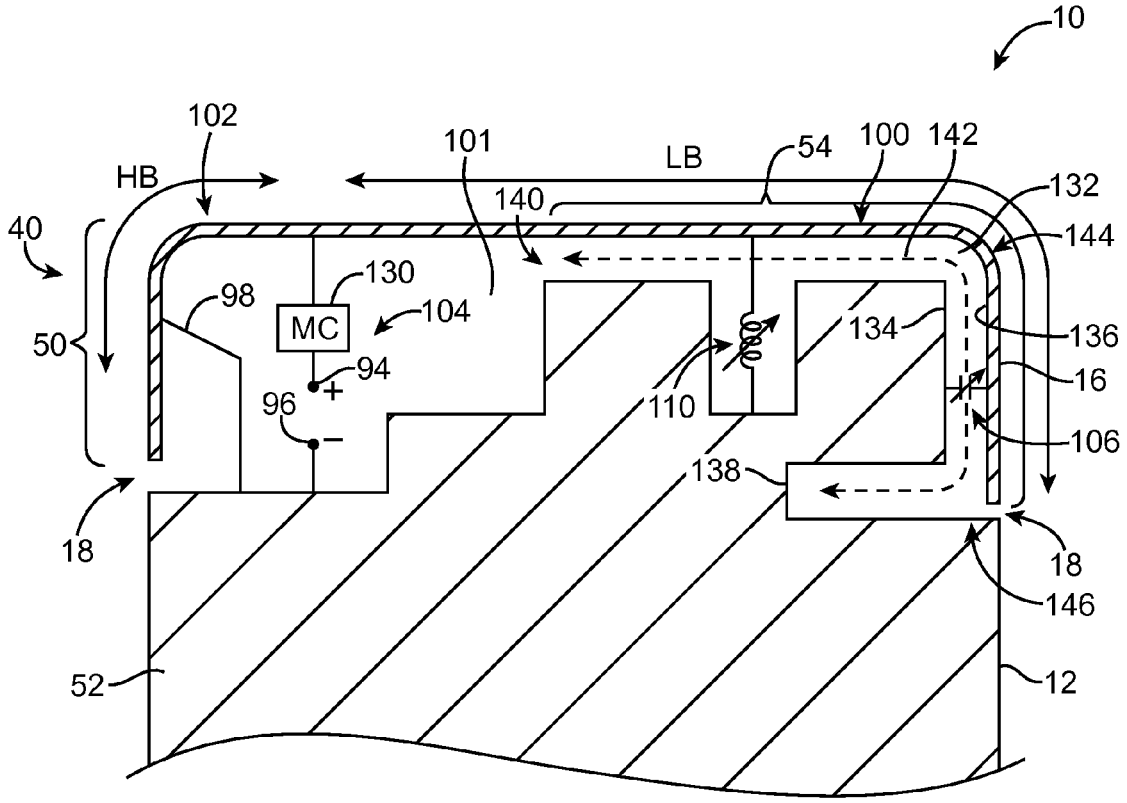
FIG. 7 is a diagram of an illustrative tunable electronic device antenna having an antenna resonating element that is formed from a portion of a peripheral conductive housing member and having a slot-based parasitic resonating element and tuning capabilities provided by adjustable inductor and adjustable capacitor circuitry in accordance with an embodiment of the present invention.

FIG. 7 is a diagram of an illustrative antenna of the type that may be implemented using conductive housing structures in electronic device 10. As shown in FIG. 7, dual arm inverted-F antenna resonating element 50 may be formed from portions of peripheral conductive housing structures 16. In particular, resonating element arm portion 102 for producing an antenna response in a high band (HB) frequency range and resonating element arm portion 100 for producing an antenna response in a low band (LB) frequency range may be formed from respective portions of peripheral conductive housing structures 16. Antenna ground 52 may be formed from sheet metal (e.g., one or more housing midplate members and/or a rear housing wall in housing 12), may be formed from portions of printed circuits, may be formed from conductive device components, or may be formed from other metal portions of device 10.

Antenna 40 may be fed by an antenna feed coupled in feed path 104. Feed path 104 may include an antenna feed formed from antenna feed terminals such as positive antenna feed terminal 94 and ground antenna feed terminal 96. Transmission line 92 (FIG. 3) may have a positive signal line coupled to terminal 94 and a ground signal line coupled to terminal 96. Impedance matching circuits such as matching circuit 130 and other circuitry (e.g., filters, switches, etc.) may be incorporated into feed path 104 or transmission line 92 if desired).

Slot-based parasitic antenna resonating element 54 is formed from slot 132. Slot 132 is surrounded by conductive structures such as metal housing structures 16 and other housing structures 12 (e.g., metal parts that form antenna ground 52), printed circuit traces, and electrical components and is filled with dielectric (e.g., air, plastic, glass, and/or other dielectric materials). Inner edge 134 of slot 132 may, for example, be formed from portions of antenna ground 52. Outer edge 136 of slot 132 may be formed from portions of peripheral conductive housing structures 16 (e.g., portions of resonating element arm 100).

As shown in FIG. 7, slot 132 has an elongated shape in which its width (i.e., the distance between edges 134 and 136) is substantially less than its length. Dashed line 142 shows how slot 132 extends from closed slot end 138 where slot 132 is bordered by conductive portions of antenna ground 52 to open slot end 140 where slot 132 is open to surrounding dielectric. With this type of configuration, slot 132 is characterized by bend 144 where slot 132 wraps around corner 144 of device 10 and is characterized by bend 146 where slot 132 departs from the periphery of device 10 and extends between opposing edges of antenna ground 52 towards closed end 138.

The length of slot 132, which affects the resonant frequency associated with slot 132, may be about 1-5 cm (as examples). With one suitable arrangement, the length of slot 132 is selected to create a resonant peak for slot 132 at about 3.5 GHz. This peak is located at a higher frequency range than typically desired for wireless communications in device 10. However, in the presence of adjustable capacitor 106 bridging slot 132 between peripheral conductive housing structures 16 and antenna ground 52, the resonant peak associated with parasitic resonating element slot 132 is shifted from 3.5 GHz to lower frequencies (e.g., frequencies in the range of about 2300 MHz to 2700 MHz). Adjustable capacitor 106 can be adjusted to tune the resonant frequency of the slot-based parasitic resonating element so that antenna 40 covers all frequencies of interest in the vicinity of the shifted resonance from slot-based parasitic antenna resonating element 54. Adjustable inductor 110 affects primarily low band performance for antenna 40 and can be adjusted to ensure that antenna 40 covers all low band frequencies of interest.

The presence of slot-based parasitic antenna resonating element 54 may help spatially distribute radio-frequency energy across the entire width of device 10 during operation of device 10 at high band frequencies. Spatially distributing radio-frequency signals in this way may help ensure that device 10 complies with regulatory limits on emitted radiation levels. In the absence of element 54, emitted energy at high frequencies may be concentrated in the vicinity of high band resonating element arm 102. In the presence of slot-based parasitic antenna resonating element 54, energy tends to be concentrated near arm 102 at lower high band frequencies and at element 54 at higher high band frequencies, so that emitted energy is distributed across the width of device 10 when averaged over high band frequencies.

Figure 8:
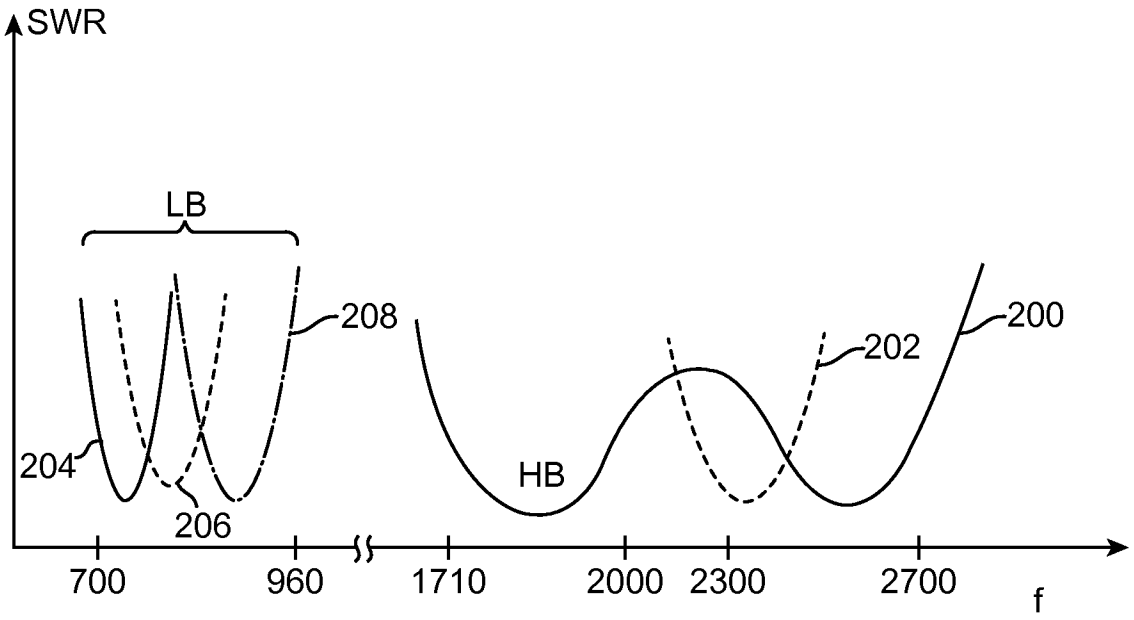
FIG. 8 is a graph of antenna performance as a function of frequency for a tunable antenna of the type shown in FIG. 7 in accordance with an embodiment of the present invention.

FIG. 8 is a graph in which antenna performance (i.e., standing wave ratio SWR) has been plotted as a function of operating frequency f. As shown in FIG. 8, antenna 40 may exhibit resonance 200. Slot-based parasitic antenna resonating element 54 may produce a resonant contribution at a relatively high frequency (e.g. 3.5 GHz). When adjustable capacitor 106 bridges slot 54 to couple edge 134 of antenna ground 52 to arm 100 (i.e., when arm 100 is coupled to ground 52 by adjustable capacitor 106), the resonance from slot-based parasitic antenna resonating element 54 may be shifted to the position shown in FIG. 8 (e.g., a position such as position 200 that covers frequencies such as frequencies from 2500 MHz to 2700 MHz for supporting operations in communications bands such as Long Term Evolution (LTE) band 38). In this position, capacitor 106 may exhibit a first capacitance (e.g., a capacitance C1 of 0.6 pF).

When it is desired to operate at lower frequencies such as frequencies associated with resonant peak position 202 of FIG. 8 (e.g., frequencies such as frequencies from 2300 MHz to 2500 MHz to cover communications bands such as LTE band 40), adjustable capacitor 106 may be adjusted to exhibit a second capacitance (e.g., a capacitance C2 of 0.8 pF). When capacitor 106 is adjusted to produce a capacitance of 0.8 pF (in this example), resonant peak 200 shifts to the position of resonant peak 202. Adjustable capacitor 106 therefore provides sufficient tuning to allow the slot-based parasitic antenna resonating element resonance from slot 54 to cover a range of frequencies from about 2300 MHz to about 2700 MHz (in this example).

High band resonance HB (e.g., frequencies from about 1710 MHz to 2000 MHz) may be covered by an antenna resonance contribution produced by high band arm 102 of antenna 40. Low band arm 100 may produce a resonance that is used in covering low band frequencies LB. Adjustable inductor 110 is coupled across gap 101 between low band resonating element arm 100 and antenna ground 52. The value of inductance produced by an adjustable inductor that bridges gap 101 such as adjustable inductor 110 is used in tuning antenna 40 in low band LB.

In the illustrative arrangement of FIG. 8, inductor 110 is being adjusted between three different states each associated with a different corresponding inductance value. Inductor 110 may be, for example, an adjustable inductor of the type shown in FIG. 6 in which L1 has a value of 12 nH and in which L2 has a value of 51 nH.

When switching circuitry 120 of FIG. 6 is placed in a position in which L1 and L2 are both switched into use in parallel, the inductance of inductor 110 will be about 10 nH. In this situation, antenna 40 (e.g., arm 100) will produce resonance peak 208. When switching circuitry 120 of FIG. 6 is placed in a configuration in which L2 is switched into use and L1 is switched out of use, inductor 110 will exhibit an inductance of about 51 nH and antenna 40 will produce resonance peak 206 (which is peak 208 shifted to a lower frequency). Switching circuitry 120 of FIG. 6 can also be adjusted so that both inductors L1 and L2 are switched out of use. In this situation, the inductance of inductor 110 will be high (effectively infinite) and antenna 40 will exhibit resonance peak 204 (which is peak 206 shifted to a lower frequency). The ability to tune the antenna resonance exhibited by low band antenna resonating element arm 100 allows antenna 40 to cover all desired frequencies of interested in low band LB (e.g., all frequencies of interest from about 700 MHz to about 960 MHz, as an example).

Figure 9:
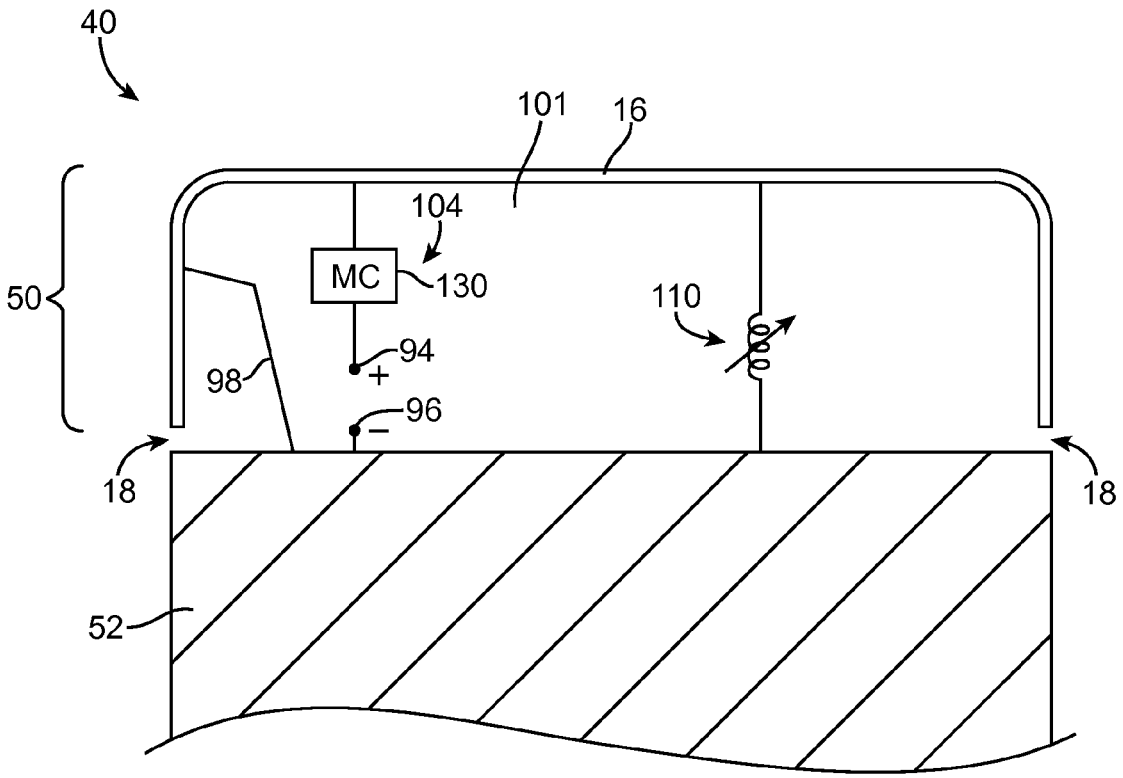
FIG. 9 is a diagram of an illustrative tunable electronic device antenna having an antenna resonating element that is formed from a portion of a peripheral conductive housing member and having tuning capabilities provided by an adjustable inductor in accordance with an embodiment of the present invention.

In situations in which it is not desired to cover communications frequencies in the range of 2300 to 2700 MHz, slot-based parasitic antenna resonating element 54 may be omitted from antenna 40, as shown in FIG. 9. In this configuration, antenna 40 may exhibit the resonances of low band LB and high band HB that are shown in FIG. 8 without exhibiting resonances 200 and 202 associated with slot-based parasitic antenna resonating element 54.

The foregoing is merely illustrative of the principles of this invention and various modifications can be made by those skilled in the art without departing from the scope and spirit of the invention.

What is claimed is:

1. An electronic device antenna, comprising:

an antenna ground;

an inverted-F antenna resonating element that has a resonating element arm that is separated from the antenna ground by a gap, wherein the inverted-F antenna resonating element comprises a metal electronic device housing structure;

a slot-based parasitic antenna resonating element that is near-field coupled to the inverted-F antenna resonating element and that comprises a slot having a first edge defined by the metal device housing structure and an opposing second edge defined by the antenna ground; and an antenna feed having a positive antenna feed terminal coupled to the inverted-F antenna resonating element and a ground antenna feed terminal coupled to the antenna ground, wherein the slot-based parasitic antenna resonating element is not directly fed by the antenna feed.

2. The electronic device antenna defined in claim 1 wherein the inverted-F antenna resonating element has an additional resonating element arm.

3. The electronic device antenna defined in claim 1 wherein the slot has a portion that is interposed between the metal electronic device housing structure and the antenna ground.

4. The electronic device antenna defined in claim 3 further comprising a capacitor that bridges the slot.

5. The electronic device antenna defined in claim 4 wherein the capacitor comprises an adjustable capacitor.

6. The electronic device antenna defined in claim 5 wherein the capacitor comprises switching circuitry and multiple fixed capacitors coupled to the switching circuitry.

7. The electronic device antenna defined in claim 6 further comprising an adjustable inductor that bridges the slot of the slot-based parasitic antenna resonating element.

8. The electronic device antenna defined in claim 7 wherein the adjustable inductor is adjusted to tune a first antenna resonance at a first frequency and wherein the adjustable capacitor is adjusted to tune a second antenna resonance at a second frequency that is greater than the first frequency.

9. The electronic device antenna defined in claim 8 further comprising a short circuit path coupled between the resonating element arm and the antenna ground across the gap.

10. The electronic device defined in claim 1 further comprising an adjustable inductor and an adjustable capacitor.

11. The electronic device defined in claim 1 further comprising an adjustable inductor coupled between the resonating element arm and the antenna ground across the slot of the slot-based parasitic antenna resonating element.

12. The electronic device defined in claim 11 further comprising a short circuit path coupled between the resonating element arm and the antenna ground across the gap.

13. The electronic device defined in claim 12 wherein the antenna feed is coupled between the resonating element arm and the antenna ground in parallel with the short circuit path.

14. An antenna, comprising:

an antenna ground;

an inverted-F antenna resonating element that is separated from the antenna ground by a gap; and a slot-based parasitic antenna resonating element having a slot with an open slot end that is formed between the antenna ground and the inverted-F antenna resonating element and a closed slot end that opposes the open slot end, wherein the closed slot end is surrounded on at least three sides by the antenna ground.

15. The antenna defined in claim 14 further comprising a capacitor that bridges the slot.

16. The antenna defined in claim 15 wherein the capacitor comprises an adjustable capacitor.

17. The antenna defined in claim 16 further comprising an adjustable inductor coupled across the gap between the inverted-F antenna resonating element and the antenna ground.

18. The antenna defined in claim 17 wherein the inverted-F antenna resonating element comprises a dual arm inverted-F antenna resonating element formed from a portion of a peripheral conductive electronic device housing structure.

19. An antenna, comprising:

a dual arm inverted-F antenna resonating element formed from a metal electronic device housing structure;

an antenna ground that is separated from the dual arm inverted-F antenna resonating element by a gap;

a short circuit branch coupled between the dual arm inverted-F antenna resonating element and the antenna ground across the gap;

an antenna feed coupled between the dual arm inverted-F antenna resonating element and the antenna ground across the gap, wherein the dual arm inverted-F antenna resonating element has a low band arm and a high band arm extending from opposing sides of the antenna feed;

a slot-based parasitic antenna resonating element having a slot, wherein the low band arm resonates in a first frequency band, the high band arm resonates in a second frequency band that is greater than the first frequency band, and the slot-based parasitic antenna resonating element resonates in a third frequency band that is greater than the second frequency band; and an adjustable inductor coupled between the low band arm and the antenna ground that bridges the slot and that is configured to adjust the first frequency band in which the low band arm resonates.

20. The antenna defined in claim 19 further comprising an adjustable capacitor that is coupled between the low band arm and the antenna ground to bridge the slot and that is configured to adjust the third frequency band in which the slot-based parasitic antenna resonating element resonates.

21. The antenna defined in claim 20 wherein the slot has a portion with a first edge that is formed from the antenna ground and a second edge that is formed from the metal electronic device housing structure.

22. The antenna defined in claim 14, further comprising:

an antenna feed having a positive antenna feed terminal coupled to the inverted-F antenna resonating element at a feed location and having a ground antenna feed terminal coupled to the antenna ground, wherein the inverted-F antenna resonating element has first and second arms that extend from opposing sides of the feed location, and the feed location is interposed between the first arm and the open slot end.

23. The electronic device antenna defined in claim 2, wherein the antenna resonating element arm resonates in a first frequency band, the additional antenna resonating element arm resonates in a second frequency band that is greater than the first frequency band, the slot-based parasitic antenna resonating element is interposed between the antenna ground and the antenna resonating element arm, and the slot-based parasitic antenna resonating element resonates in a third frequency band that is greater than the second frequency band.

24. The electronic device defined in claim 23, further comprising:

an adjustable capacitor coupled between the antenna resonating element arm and the antenna ground across the slot-based parasitic antenna resonating element, wherein the adjustable capacitor has first and second configurations, the slot-based parasitic antenna resonating element resonates in the third frequency band while the adjustable capacitor is in the first configuration, and the slot-based parasitic antenna resonating element resonates in a fourth frequency band that is greater than the third frequency band while the adjustable capacitor is in the second configuration.

25. The antenna defined in claim 20, wherein the slot of the slot-based parasitic antenna resonating element is interposed between the low band arm and the antenna ground.

* * * * *